US007810860B2

(12) United States Patent
Bell

(10) Patent No.: US 7,810,860 B2
(45) Date of Patent: Oct. 12, 2010

(54) PORTABLE PET FAECES COLLECTION CONTAINER

(76) Inventor: Neil Bell, 16 Greenmount Road, Darlington, Durham County (GB) DL3 8EP ( * ) Notice: Subject to any disclaimer, the term of this patent is extended or adjusted under 35 U.S.C. 154(b) by 0 days.

(21) Appl. No.: 12/368,209

(22) Filed: Feb. 9, 2009

(65) Prior Publication Data

US 2009/0267370 A1 Oct. 29, 2009

Related U.S. Application Data

(63) Continuation of application No. 12/099,894, filed on Apr. 9, 2008, now abandoned, which is a continuation of application No. 11/744,740, filed on May 4, 2007, now abandoned, which is a continuation of application No. 11/075,366, filed on Mar. 8, 2005, now abandoned.

(30) Foreign Application Priority Data

Dec. 15, 2004 (GB) ..... 0427527.7

(51) Int. Cl.
*A01K 29/00* (2006.01)

(52) U.S. Cl. ..... 294/1.3

(58) Field of Classification Search ..... 294/1.3, 294/1.4, 1.5, 55; 15/257.3, 257.6
See application file for complete search history.

(56) References Cited

U.S. PATENT DOCUMENTS

| | | | | |
|---|---|---|---|---|
| 3,929,363 | A | | 12/1975 | Kahan |
| 4,003,595 | A | | 1/1977 | Fano et al. |
| 4,102,547 | A | * | 7/1978 | Williams ..... 294/1.3 |
| 4,120,264 | A | | 10/1978 | Carter |
| 4,193,623 | A | | 3/1980 | Forsythe et al. |
| 4,368,907 | A | * | 1/1983 | Ross ..... 294/1.4 |
| D334,638 | S | | 4/1993 | Blackman |
| 5,382,063 | A | | 1/1995 | Wesener et al. |
| 5,540,469 | A | | 7/1996 | Albert |
| 5,551,569 | A | | 9/1996 | Garvin-Mazzarisi |
| 5,575,520 | A | | 11/1996 | Northcutt |
| 5,586,521 | A | | 12/1996 | Kelley |
| 5,794,566 | A | | 8/1998 | Goetz et al. |
| 6,102,457 | A | | 8/2000 | Smith |
| 6,164,710 | A | | 12/2000 | Shibuya |
| 6,941,896 | B1 | | 9/2005 | Morin |
| 2004/0119304 | A1 | | 6/2004 | Iso et al. |
| 2004/0189026 | A1 | | 9/2004 | Denham et al. |

FOREIGN PATENT DOCUMENTS

| | | | |
|---|---|---|---|
| AU | 3389993 | A | 12/1993 |
| CH | 684045 | A5 | 7/1994 |
| DE | 2639518 | A1 | 3/1978 |
| JP | 2000316409 | A | 11/2000 |
| WO | 02/071838 | A1 | 9/2002 |

* cited by examiner

*Primary Examiner*—Paul T Chin
(74) *Attorney, Agent, or Firm*—Wasserman, Comden & Casselman & Esensten, LLP; Reid Dammann, Esq.

(57) ABSTRACT

A portable container for faeces having a body provided with a first chamber and a second chamber. The first chamber is provided with a first closure which in a first position allows access to the first chamber and in a second position seals the first chamber. The second chamber is provided with an opening which allows access to the second chamber.

16 Claims, 5 Drawing Sheets

PORTABLE PET FAECES COLLECTION CONTAINER

CROSS-REFERENCE TO RELATED APPLICATIONS

This application is a continuation of U.S. patent application Ser. No. 12/099,894, filed Apr. 9, 2008, which is a continuation of U.S. patent application Ser. No. 11/744,740 filed May 4, 2007, which application was a continuation of U.S. patent application Ser. No. 11/075,366 filed on Mar. 8, 2005, which application claims the benefit of GB 0427527.7 under 35 U.S.C. §119. These prior documents are incorporated herein by reference.

BACKGROUND

The present invention relates to a portable container for storing feces, particularly pet or animal feces.

It is known for pet owners to collect their pet's feces in disposable bags and to dispose of the bags at an appropriate location. This is normally done as soon as possible for hygiene and comfort reasons. Some public places are provided with waste bins specifically designated for pet or animal feces. However, many public places do not have designated waste bins or even any form of waste bin. Owners who collect the feces in a disposable bag have to carry the disposable bag about their person until they find a waste bin. This is inconvenient, unappealing and unhygienic, particularly given the risk of leakage from the flimsy bags employed. Frequently, owners do not collect the feces as a result. This is unhygienic, unsightly and is illegal in respect of some public places.

SUMMARY OF THE INVENTION

The present invention aims to provide a portable container for storing feces after their collection which is convenient to use and/or more hygienic to use.

According to a first aspect of the present invention, there is provided a portable container for feces, the container comprising:

a body, the body being provided with a first chamber and a second chamber, the first chamber being provided with a first closure which in a first position allows access to the first chamber and in a second position seals the first chamber, the second chamber being provided with an opening which allows access to the second chamber.

According to a second aspect of the present invention, there is provided a method of collecting feces, the method comprising:

providing a container, the container comprising a body, the body being provided with a first chamber and a second chamber, the first chamber being provided with a first closure;

removing a bag from the second chamber;

collecting faeces in the bag;

opening the first closure for the first chamber; and placing the bag in the first chamber.

The first and/or second aspects of the present invention may include one or more of the possibilities, features and options set out elsewhere in this document, including from amongst the following.

The container is preferably resilient. The container may be moulded or cast. The container may be formed from metal and/or plastics. It is preferred that the container be formed from polyethylene or polypropylene.

The container is preferably provided with one or more attachment locations, for instance in the form of an aperture. The aperture may cooperate with a clip. An attachment location may be used to connect the container to the user and/or the animal and/or a lead or other component connected to the animal. An attachment location may be provided on a projection connected to the container or body. Preferably the body is provided with a handle. The container may be incorporated into the lead for an animal, for instance by the user holding the handle, with the container connected to the lead and with the lead connected to the animal.

The first chamber and the second chamber may be separate parts, potentially connected together to form the container. Preferably the first chamber and second chamber are integrally provided.

Preferably the first chamber is separated from the second chamber by a partition. The partition may be a planar wall. The partition may be an integral part of the body. Preferably the partition is provided closer to the opening for the second chamber than to the opening for the first chamber. The partition may be provide between 20% and 40% of the way along the length of the container, measured from the opening to the second chamber.

The first chamber preferably receives one or more bags containing faeces. The first chamber may be circular in cross-section. The first chamber may be 10% or more larger than the second chamber, preferably 20% or more larger, in terms of its diameter and/or maximum width. The first chamber may be between two and five times the length of the second chamber. The first chamber may have at least twice, preferably at least three times, ideally at least four times, the volume of the second chamber.

The second chamber preferably receives one or more unused bags.

The bags may be disposable. The bags made be flexible. The bags may be formed of plastics, for instance polyethylene. Preferably, the unused bags are in the form of a roll. Perforations or weakened points may be provided between individual unused bags. An unused bag may be removed from the second chamber by pulling the bag through the opening. An unused bag may be removed from the second chamber by opening a second closure, for instance by moving the second closure from a second position to a first position.

Preferably the feces are collected in the bag with the bag detached from the container.

The first closure is preferably a lid. The first closure is preferably pivotally mounted on the body. Preferably the first closure is mounted by a hinge. The mounting for the hinge may be provided on one or more projections from the body and/or first closure. The first closure and the body may be connected by a pin. The first closure may be mounted on the body by a screw fit engagement.

Preferably a resilient component encourages the first closure to the second position. The first closure may be urged to the second position by a spring. The first closure may be moved from the second position to the first position by the application of force to a part of the first closure by the user. The force may be applied to an element extending from the first closure, preferably extending past the pivot or hinge therefore. The element may be provided with one or more ridges and/or grooves.

Preferably the used bag is inserted into the first chamber with the first closure in the first position. In the first position, the first closure may have been rotated through an angle of 90° or greater from its second position.

In the second position the first closure may seal the first chamber by abutting the body. The first closure may enclose the end of the first chamber and/or body. The first closure is preferably biased against the first chamber and/or body by a force greater than the force of gravity acting on the bag and feces the bag contains.

The method may include moving the first closure from the second position to the first position. Preferably the movement to the first position allows the dispense of a used bag, 10 preferably into a waste receptacle, such as a bin.

The opening in the second chamber may be such that only one bag at a time can pass there through. Preferably the opening is such that a bag can be pulled through. Preferably the opening is such that a bag cannot fall through.

The second chamber may be provided with a second closure. Preferably the opening is provided in the second closure. The second closure may have a first position in which it allows access to the second chamber and a second position in which it seals the second chamber. The second closure is preferably a lid. The second closure is preferably pivotally mounted on the body. Preferably the second closure is mounted by a hinge. The mounting for the hinge may be provided on one or more projections from the body and/or second closure. The second closure and the body may be connected by a pin. The second closure may be mounted on the body by a screw fit engagement.

Preferably a resilient component encourages the second closure to the second position. The second closure may be urged to the second position by a spring. The second closure may be moved from the second position to the first position by the application of force to a part of the second closure by the user. The force may be applied to an element extending from the second closure, preferably extending past the pivot or hinge therefore, The element may be provided with one or more ridges and/or grooves.

In the second position the second closure may seal the second chamber by abutting the body. The second closure may enclose the end of the second chamber and/or body. The second closure is preferably biased against the second chamber and/or body by a force greater than the force of gravity acting on the unused bags.

Preferably the unused bag is removed from the second chamber with the second closure in the first position. In the first position, the second closure may have been rotated through an angle of 90° or greater from its second position.

The container may include an air freshener. Preferably the air freshener is replaceable. Preferably the air freshener is provided on the first closure.

BRIEF DESCRIPTION OF THE SEVERAL VIEW OF THE DRAWINGS

The invention will now be described, by way of example only, and with reference to the accompanying drawings in which.

DETAILED DESCRIPTION OF THE INVENTION

Figure 1:
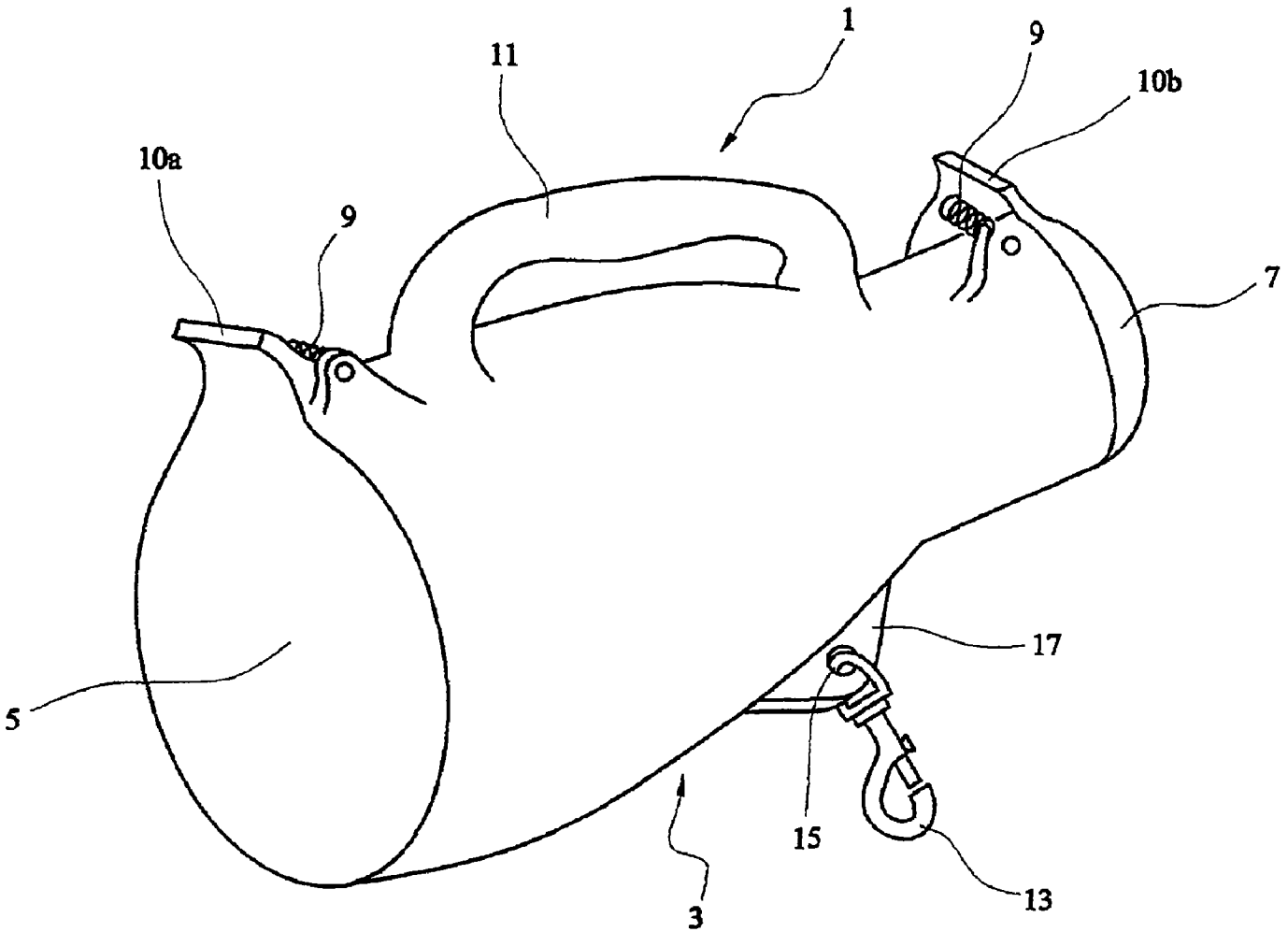
FIG. 1 is a perspective view of a container according to an embodiment of the present invention.

As shown in FIG. 1, the container 1 is formed of a body 3 which is open at each end. The ends are closed by a first lid 5 and a second lid 7. The lids 5, 7 are biased, in each case, to the illustrated closed position by a coiled spring 9. By applying pressure to the element 10*a* on the first lid 5 or the element lob on the second lid 7, the respective lids can be opened.

A handle 11 is provided on the body 3 to provide a user with a convenient means for gripping the container 1. This is particularly advantageous when the container 1 is incorporated into the lead used by the animal, with the handle 11 held by the user and the animal attached to a clip 13. The clip 13 is connected to the container by engagement with an aperture 15 on a projection 17. The clip 13 can also be used to attach the container 1 to the user, for instance for carrying.

Figure 2:
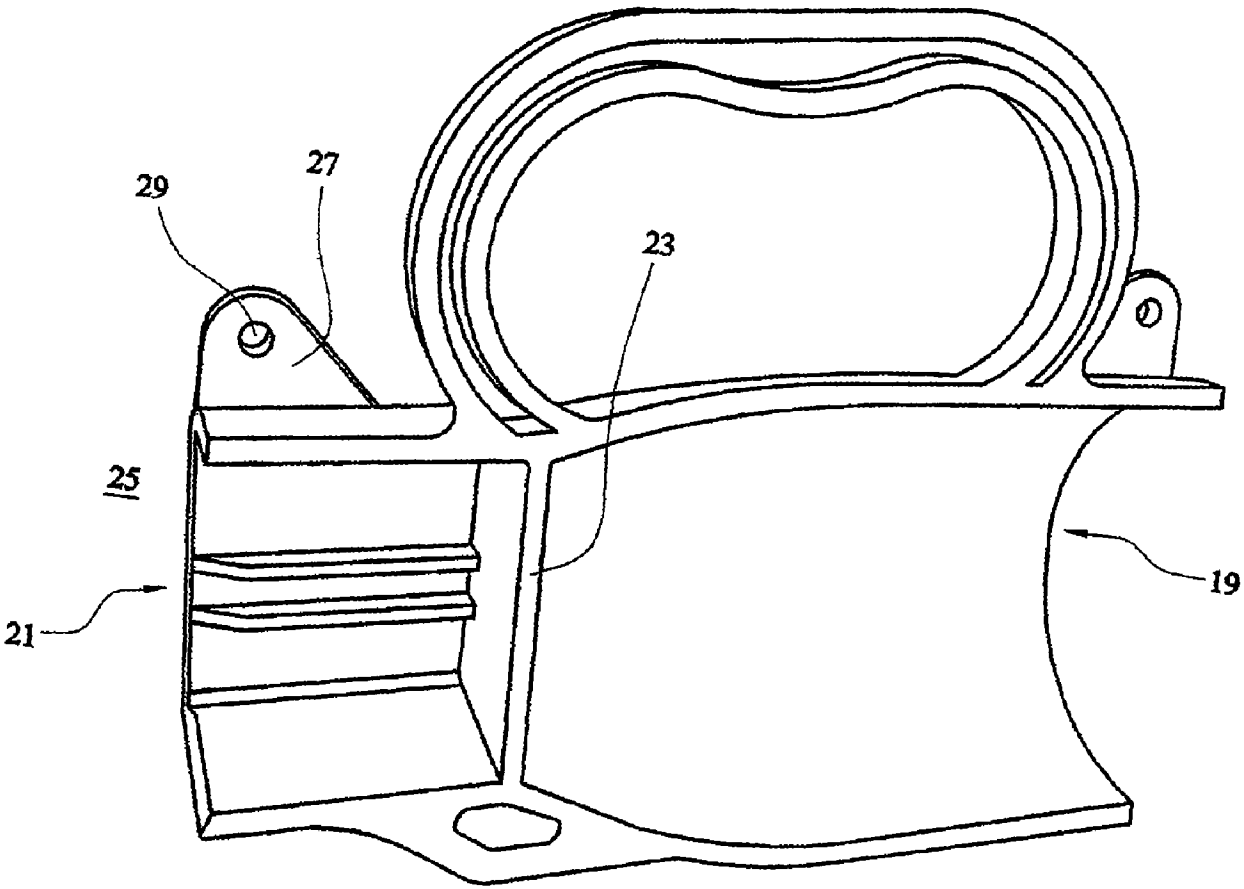
FIG. 2 is a perspective view showing the right hand side of the container body of the embodiment of FIG. 1 in cross-section.

Opening the larger first lid 5 provides access to a first chamber 19, visible in the cross-section of FIG. 2. Opening the smaller second lid 7 provides access to a second chamber 21, also visible in FIG. 2. The first chamber 19 is separated from the second chamber 21 by a partition 23.

The second chamber 21 is of a sufficient size to store a number of unused disposable bags or collecting and containing feces. The first chamber 19 is larger and longer than the second chamber 21 so that it is of a sufficient size to store one or more used bags containing feces. The partition 23 keeps the clean unused bags and the dirty used bags entirely separate from one another.

Figure 3:
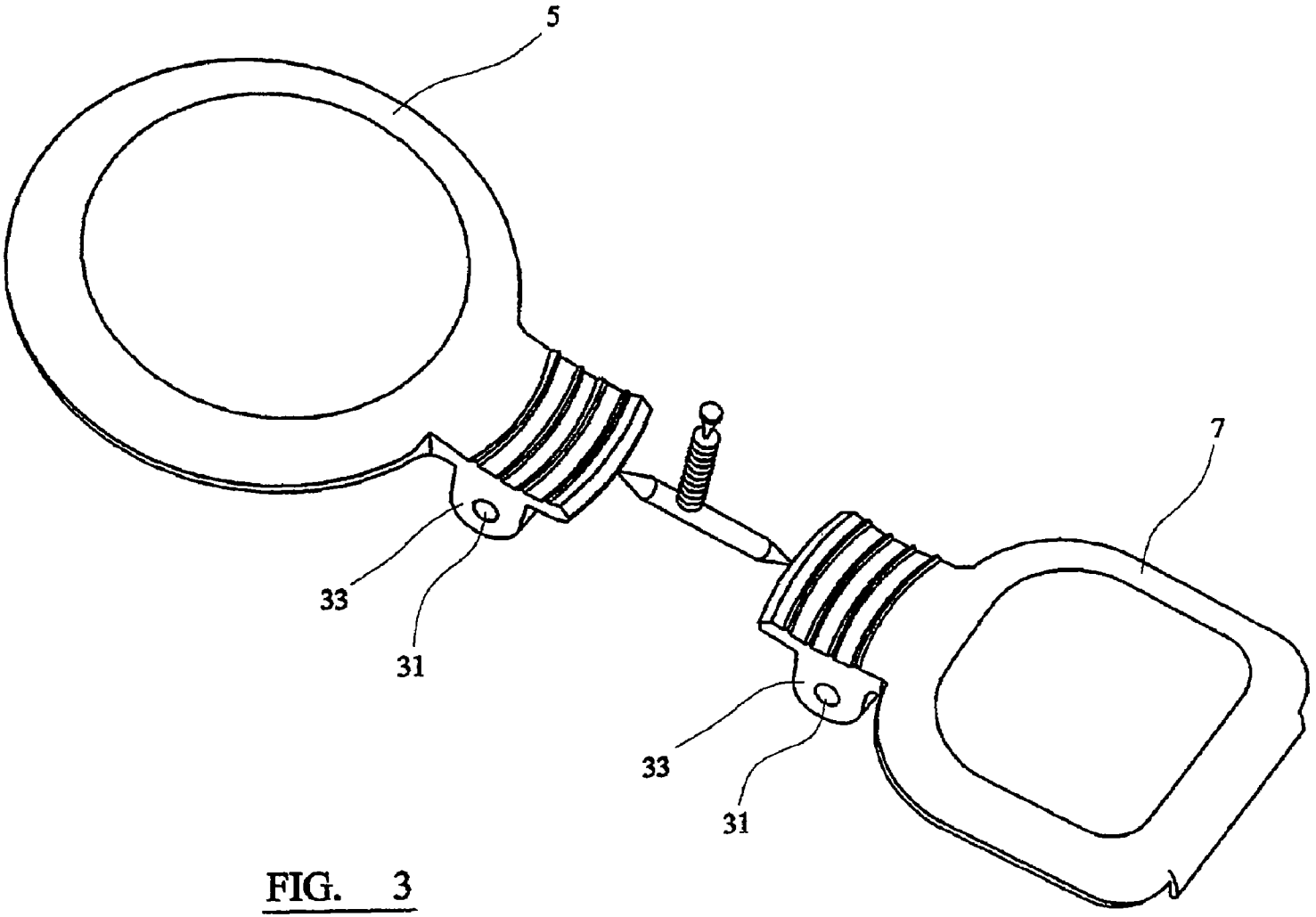
FIG. 3 is a perspective view of the two lids for the container of FIG. 1.

Near the opening 25 into the second chamber 21, the body 3 is provided with a projection 27 which in turn is provided with an aperture 29. A corresponding structure is provided on the other half of the body 3. As illustrated in FIG. 3, the first lid 5 and the second lid 7 are provided with a pair of apertures 31 on projections 33. During assembly, the aperture 29 on the body, the apertures 31 on the second lid 7 and the other aperture on the other half of the body are aligned with on another and a pin is inserted to provide the pivot for the second lid 7 on the body 3. An equivalent structure and assembly is used for the first lid 5.

The container 1 may be molded in plastics, for instance polypropylene. The apertures 15, 29, 31 may be formed during molding or provided later, for instance by drilling. A pet owner can collect and store their pet's feces using the portable feces container 1 as follows. The user opens the second lid 7 to access the second chamber 21 and removes an unused disposable bag. The user then places the feces within the disposable bag and then seals the disposable bag, for example by tying a knot in the open end of the bag. The user then opens the first lid 5 to access the first chamber 19 and places the bag and its contents in it. The first lid 5 is then released to close the first chamber 19. The feces are thus hygienically stored in the container until the user locates a designated waste disposal point for the feces. The rigid nature of the container 1 also protects the bag during carrying and so prevents inadvertent punctures or tears in the bag occurring. The portable feces container 1 can be used repeatedly, due to the large size of the first chamber 19, before finally disposing of the feces at an appropriate location.

Figure 4:
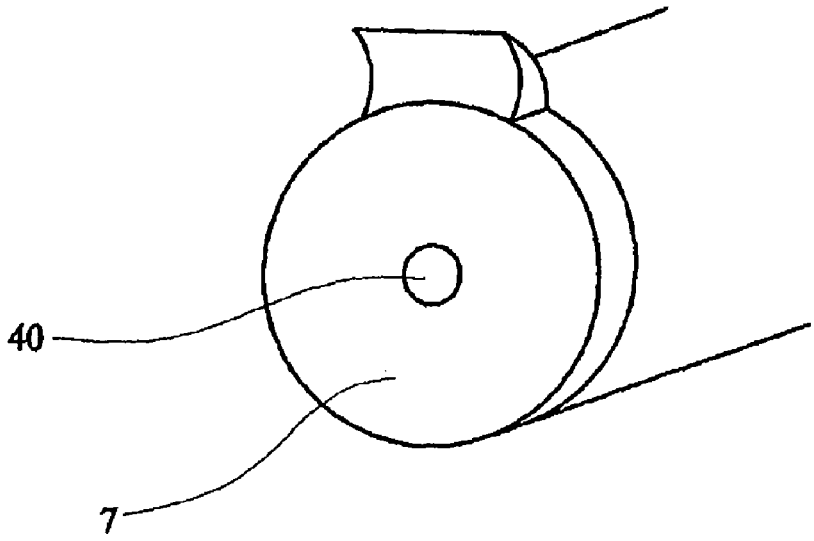
FIG. 4 is an illustration of an alternative lid embodiment.

In the embodiment of the invention illustrated in FIG. 4, a slightly different design of second lid 7 is provided. In this case, the second lid 7 can be opened as described above to provide bags in the second chamber. Rather than having to open the second lid 7 to remove a bag for use, however, the bag is pulled through a small hole 40. The hole 40 is 10 small enough that a bag will not fall out of it. This form of lid offers more convenient access to a bag and retains all the other clean bags whilst one is removed.

Figure 5:
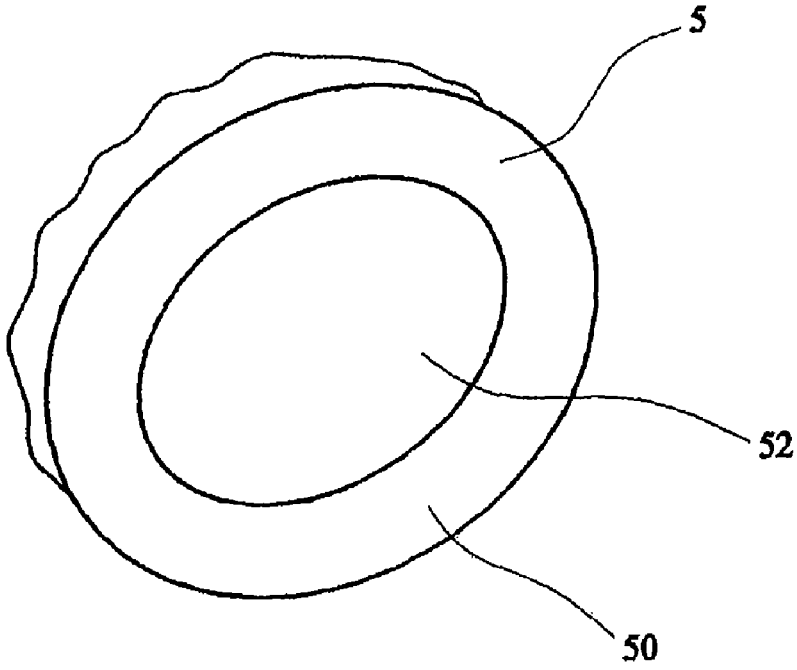
FIG. 5 is an illustration of a further alternative lid embodiment.
Figure 6:
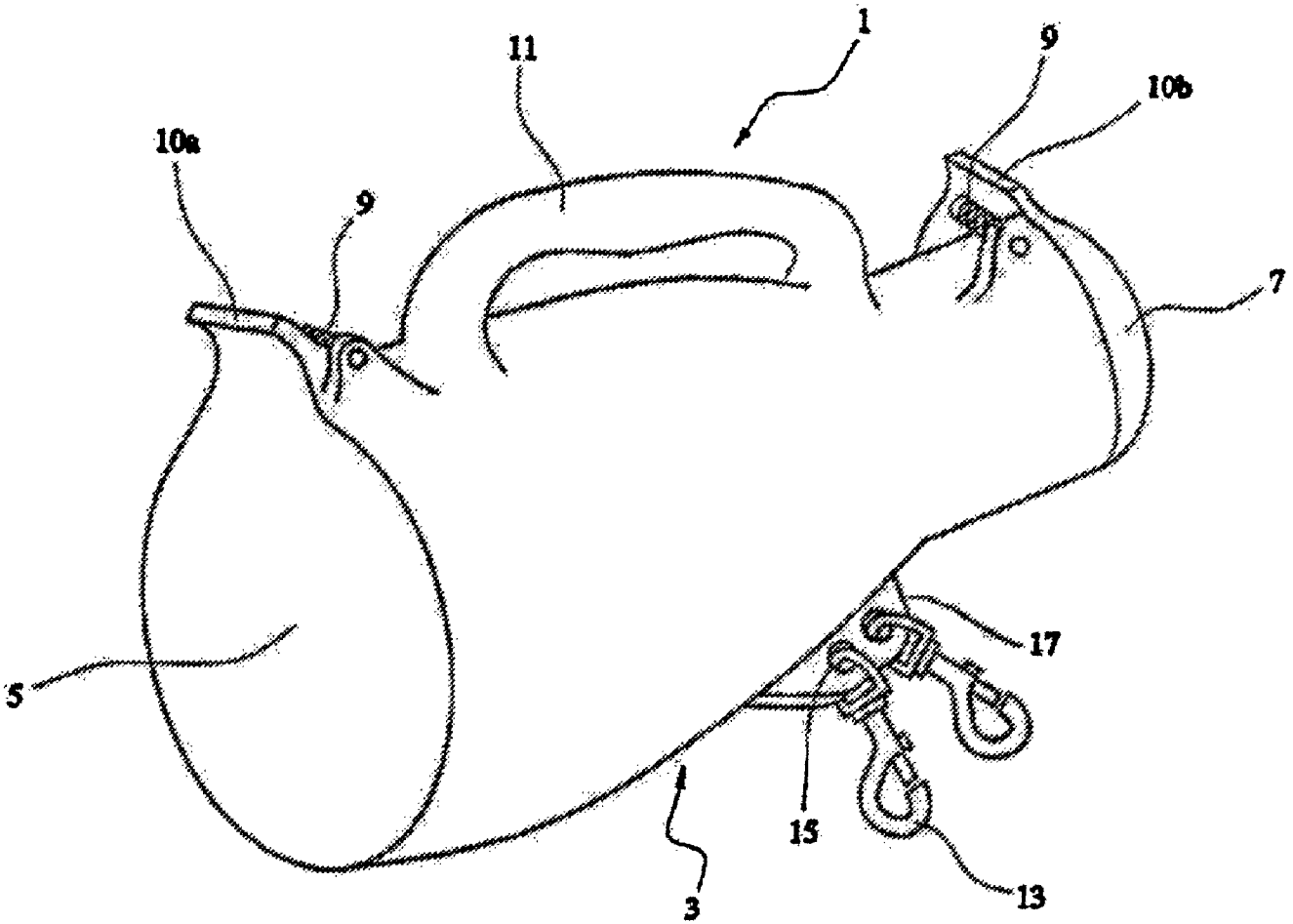
FIG. 6 is an illustration of a further alternative including more than one attachment locations.

In the embodiment of the invention illustrated in FIG. 5, the inside surface 50 of the first lid 5 is provided with a removable air freshener 52. This counteracts any odor from the used bag stored in the first chamber 19. The air freshener 52 can be held in place by one or 15 more clips (not shown) or be held in place by adhesive provided on the inside surface 50 or more preferably on the air freshener 52.

Portable feces containers according to the present invention have the advantage that they provide a closed container for the collection and storage of feces. By having a chamber for holding unused disposable bags in addition to a chamber for storing used disposable bags containing feces a convenient system is provided. A pet owner does not have to gather disposable bags and store them about their person ready for use. The present invention therefore provides the pet owner with the convenience of only having to take the portable feces container when exercising their animal, without the need to carry separate bags too. Furthermore, the owner can use a disposable bag to collect the feces, seal the bag (for example by tying a knot in the open end), and then store it in the second chamber very conveniently. The container of the present invention also has the advantage that it enables an owner to store multiple used and unused disposable bags together. This means that the owner is free to take their animal out for extended periods of time without the need to locate and use a number of waste bins or obtain further disposable bags.

The invention claimed is:

1. A portable container for faeces, the container comprising:

a substantially rounded body, the body being provided with a first chamber and a second chamber, the first chamber being separated from the second chamber by a partition;

the first chamber being provided with a first closure which in a first position allows access to the first chamber and in a second position seals the first chamber, the first chamber receiving one or more dirty used bags containing faeces in use;

the second chamber being provided with an opening which allows access to the second chamber, the second chamber receiving a plurality of clean unused bags in use;

the partition keeping the clean unused bags entirely separate from the dirty used bags;

wherein the body is provided with a u-shaped handle and the human user holds the handle in use;

wherein the container is provided with one or more attachment locations, a lead being connected to one of the one or more attachment locations in use and the lead also being connected to an animal in use.

2. A container according to claim 1, wherein the first chamber and the second chamber are integrally provided.

3. A container according to claim 1, wherein the partition is provided closer to the opening for the second chamber than to the opening for the first chamber.

4. A container according to claim 1, wherein the first chamber is 10% or more larger than the second chamber in terms of its diameter and/or maximum width.

5. A container according to claim 1, wherein the first closure is pivotally mounted on the body.

6. A container according to claim 5, wherein a resilient component encourages the first closure to the second position.

7. A container according to claim 5, wherein the first closure is a lid.

8. A container according to claim 1, wherein the second chamber is provided with a closure and a hole is provided in the closure, the hole being sized and configured such that only one bag at a time can pass there through.

9. A container according to claim 1, wherein the second chamber is provided with a second closure.

10. A container according to claim 9, wherein the second closure has a first position in which it allows access to the second chamber and a second position in which it seals the second chamber.

11. A container according to claim 10, wherein the second closure is pivotally mounted on the body.

12. A container according to claim 11, wherein a resilient component encourages the second closure to the second position.

13. A container according to claim 10, wherein the second closure is a lid.

14. A container according to claim 1, wherein the container includes an air freshener.

15. A container according to claim 1, in which the first chamber has a volume at least twice the volume of the second chamber.

16. A container according to claim 1, in which an air freshener is provided on the first closure.

* * * * *